United States Patent [19]

VanRens

[11] Patent Number: 4,872,637

[45] Date of Patent: Oct. 10, 1989

[54] DIE MEMBER FOR FORMING A LOST FOAM PATTERN

[75] Inventor: Russell J. VanRens, Milwaukee, Wis.

[73] Assignee: Outboard Marine Corporation, Waukegan, Ill.

[21] Appl. No.: 202,876

[22] Filed: Jun. 3, 1988

[51] Int. Cl.[4] ..... B22C 7/02

[52] U.S. Cl. ..... 249/59; 249/63; 249/145; 425/DIG. 58; 164/45; 164/246; 164/342

[58] Field of Search ..... 164/34, 35, 36, 45, 164/137, 245, 246, 249, 339, 340, 342; 249/61, 62, 63, 144, 145, 59; 425/DIG. 12, DIG. 58

[56] References Cited

U.S. PATENT DOCUMENTS

| | | | |
|---|---|---|---|
| Re. 31,488 | 1/1984 | Trumbauer et al. | 164/32 |
| 4,092,958 | 6/1978 | Hale | 123/73 |
| 4,129,103 | 12/1978 | Pichl | 123/52 |
| 4,243,093 | 1/1981 | Nieman | 164/96 |
| 4,632,169 | 12/1986 | Osborn | 164/45 |
| 4,640,333 | 3/1987 | Martin et al. | 164/246 |
| 4,657,063 | 4/1987 | Morris | 164/45 |
| 4,691,754 | 9/1987 | Trumbauer | 164/9 |
| 4,721,149 | 1/1988 | Hesterberg et al. | 164/244 |

*Primary Examiner*—Richard K. Seidel
*Attorney, Agent, or Firm*—Michael, Best & Friedrich

[57] ABSTRACT

A die member for forming a foam pattern for casting a cylinder block in a lost foam casting process, the pattern having a cylindrical bore with an axis, and a helical transfer passage including a first portion permitting die member separation in a direction along the axis of the cylindrical bore and an undercut portion preventing one-piece die member separation in the direction along the axis of the cylindrical bore, the die member comprising a main portion forming at least a portion of the cylindrical bore and including a projection forming a first part of the first portion of the transfer passage, and a core carried by the main portion and movable relative to the main portion along a line in a plane substantially perpendicular to the axis of the cylindrical bore, the core being movable between an extended position in which the core forms a second part of the first portion of the transfer passage and the undercut portion of the transfer passage, and a retracted position in which the core affords separation of the core through the second part of the first portion of the transfer passage and in common with separation of the projection from the first portion of the transfer passage in the direction along the axis of the cylindrical bore.

9 Claims, 1 Drawing Sheet

DIE MEMBER FOR FORMING A LOST FOAM PATTERN

RELATED APPLICATIONS

This application is related to my following co-pending applications filed of even date herewith:

Ser. No. 202,970 Filed: June 3, 1988, Entitled "Lost Foam Pattern Assembly For V-Block Engine".

Ser. No. 202,693 Filed: June 3, 1988, Entitled "Lost Foam Casting Assembly".

Ser. No. 202,489 Filed: June 3, 1988, Entitled "Lost Foam Transfer Passage Cavity Construction".

Ser. No. 202,212 Filed: June 3, 1988, Entitled "Lost Foam Engine Block Pattern".

BACKGROUND OF THE INVENTION

The invention relates to die casting of foam patterns for use in casting a two-cycle engine block in a lost foam casting process. More particularly, the invention relates to die casting of such patterns with a cylinder bore and a helical transfer passage which, because of its helical or inclined relation to the axis of the cylinder bore, includes an undercut portion which prevents one-piece die member removal in a direction along the axis of the cylinder bore. Also, the invention relates to such patterns which include a helical finger passage adjacent the transfer passage. Still more particularly, the invention relates to die members for die casting such patterns.

In the past, helical transfer passages were formed by a core which formed a major Portion of the transfer passage, including the undercut area, and which was pulled or removed entirely from the transfer passage along an axis at a slight angle relative to the cylinder axis before pulling or withdrawal of the supporting die member along the cylinder axis. Such removal involved a relatively long stroke length and increased the die casting cycle time. Because of the relatively complex shape of the core, it was difficult to fit the core accurately into the supporting die member so that the core could stroke freely while not allowing a large gap into which flash could enter. This construction also presented a maintenance problem.

Attention is directed to the following U.S. Patents:

| | | |
|---|---|---|
| Hale | 4,092,958 | Jun. 06, 1978 |
| Pichl | 4,129,103 | Dec. 12, 1978 |
| Neiman | 4,243,093 | Jan. 06, 1981 |
| Osborn | 4,632,169 | Dec. 30, 1986 |
| Martin | 4,640,333 | Feb. 03, 1987 |
| Morris | 4,657,063 | Apr. 14, 1987 |
| Trumbauer | 4,691,754 | Sep. 08, 1987 |
| Hesterberg | 4,721,149 | Jan. 26, 1988 |
| Trumbauer | Re.31,488 | Jan. 10, 1984 |

Particular attention is directed to U.S. Pat. No. 4,632,169, to Osborn, which discloses a three-piece lost foam pattern. Osborn's transfer passages do not extend helically with respect to the cylinder axis.

SUMMARY OF THE INVENTION

The invention provides a die member for forming a foam pattern for casting a cylinder block in a lost foam casting process, the pattern having a cylindrical bore with an axis, and a helical transfer passage including a first portion permitting die member separation in a direction along the axis of the cylindrical bore, and an undercut portion preventing one-piece die member separation in the direction along the axis of the cylindrical bore, the die member comprising a main portion forming at least a portion of the cylindrical bore and including a projection forming a first part of the first portion of the transfer passage, and a core carried by the main portion and movable relative to the main Portion along a line in a plane substantially perpendicular to the axis of the cylindrical bore, the core being movable between an extended position in which the core forms a second part of the first portion of the transfer passage and the undercut portion of the transfer passage, and a retracted position in which the cord affords removal of the die member from the pattern in the direction along the axis of the cylindrical bore.

In one embodiment, the pattern also has a helical finger passage adjacent the transfer passage, the core forms the finger passage when the core is in the extended position, and the core is completely withdrawn from the finger passage when the core is in the retracted position.

In one embodiment, one of the transfer passage and the finger passage includes a second undercut portion preventing one-piece core separation along the line, and the main portion includes a projection forming the second undercut portion.

In one embodiment, the transfer passage includes a second undercut portion preventing one-piece core separation along the line, and the Projection forms the second undercut portion.

The invention also provides a die member for forming a foam pattern for casting a cylinder block in a lost foam casting process, the pattern having a cylindrical bore with an axis, a helical transfer passage, and a helical finger passage adjacent the transfer passage, the die member comprising a main portion forming at least a portion of the cylinder bore, and a core carried by the main portion and movable relative thereto, the core being movable between an extended position in which the core forms at least a portion of each of the transfer passage and the finger passage, and a retracted position in which the core affords removal of the die member from the pattern in the direction along the axis of the cylindrical bore.

In one embodiment, one of the transfer passage and the finger passage includes first and second portions, the main portion includes a projection forming the second portion and a first part of the first portion, the core forms a second part of the first portion and the other of the transfer passage and the finger passage when the core is in the extended position, and the core is at least partially withdrawn from the second part and from the other of the transfer passage and the finger passage when the core is in the retracted position.

In one embodiment, the first portion permits movable core separation along a line in a Plane substantially perpendicular to the axis of the cylindrical bore, the second portion is undercut and prevents one-piece core separation along the line, and the core is movable relative to the main portion along the line.

In one embodiment, the transfer passage includes the first and second portions.

A principal feature of the invention is the provision of a die member for forming a cylinder bore and a helical transfer passage, the die member comprising a main portion including a projection forming a first portion of the transfer passage, and a core which is movable relative to the main portion along a line in a plane substantially perpendicular to the axis of the cylinder bore and which forms a second portion of the transfer passage. This arrangement provides at least three advantages. First, the slot in the main portion, into which the core telescopes or slides, is easy to machine accurately. Second, the stroke length of the movable core is less than 25% of the stroke length of the movable core of the above-described Prior art arrangement. Third, because of the short stroke length, two movable cores can be activated simultaneously with a single cam mechanism.

Another principal feature of the invention is the provision of a die member for forming a cylinder bore, a helical transfer passage, and a helical finger passage, the die member comprising a main portion, and a core which is movable relative to the main portion and which forms at least a portion of the transfer passage and at least a portion of the finger passage.

Other features and advantages of the invention will become apparent to those skilled in the art upon review of the following detailed description, claims and drawings.

Figure 3:
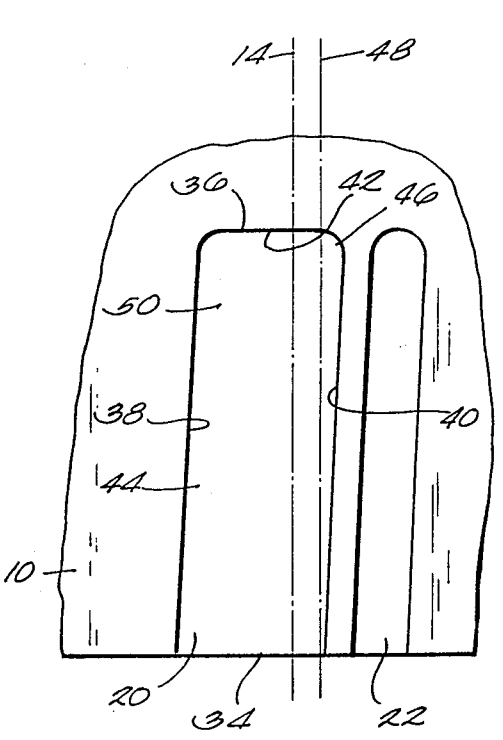
FIG. 3 is an elevational view taken along line 3—3 in FIG. 1.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Shown fragmentarily in the drawings is one piece or a portion 10 of a multi-piece foam pattern (not otherwise shown) for casting a two-cycle engine block (not shown) in a lost foam casting process.

The pattern portion 10 includes a cylindrical bore 12 which is filled with sand during the lost foam casting process, which provides the cylinder bore of the engine block, and which has an axis 14. The pattern portion 10 also includes portions of exhaust and boost passages 16 and 18, respectively, which communicate with the cylindrical bore 12 and which respectively provide the exhaust and boost passages of the engine block. The pattern portion 10 also includes portions of opposed transfer passages 20 which communicate with the cylindrical bore 12 and which provide the transfer passages of the engine block. The pattern portion 10 further includes portions of a pair of finger passages 22 which are located adjacent the transfer passages 20, which communicate with the cylindrical bore 12, and which provide the finger passages of the engine block.

Figure 2:
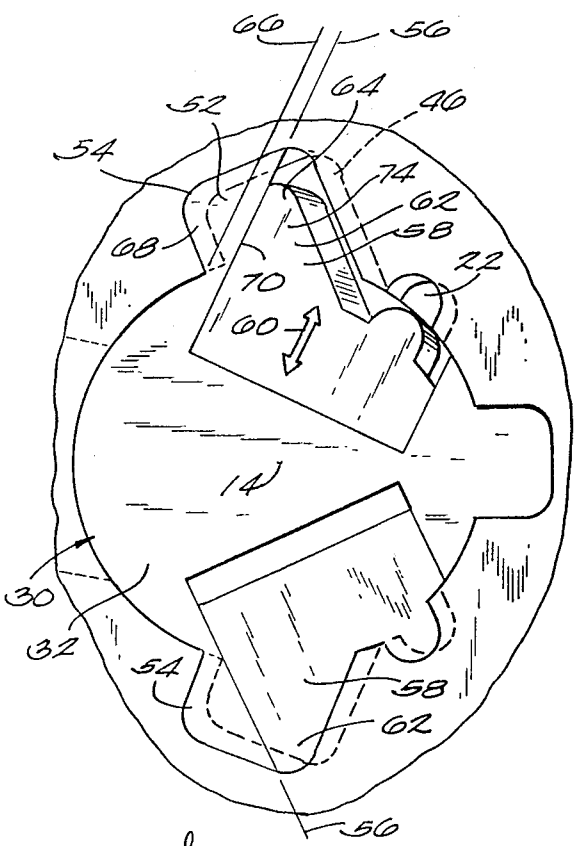
FIG. 2 is a bottom plan view of the pattern and the die member.
Figure 1:
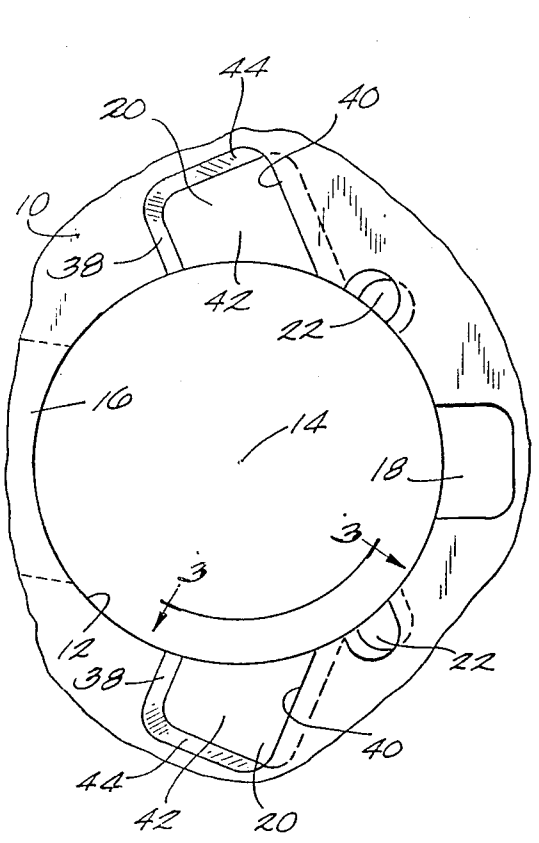
FIG. 1 is a bottom plan view of a lost foam pattern which is formed by a die member embodying the invention.

During the process for die casting the pattern portion 10, the pattern portion 10 is formed between a first die member 30 (shown in FIG. 2) and a second die member (not shown) which open and close in a direction along the axis 14 of the cylindrical bore 12, as is known in the art. The die member 30 comprises a main portion 32 forming the cylindrical bore 12 and the boost passage 18. Referring to FIG. 2, the pattern portion 10 and die member 30 are separated by movement of the pattern portion 10 away from the viewer relative to the die member 30, or by moving the die member 30 toward the viewer relative to the pattern portion 10. Referring to FIG. 3, the pattern portion 10 and die member 30 (not shown in FIG. 3) are separated by moving the pattern portion 10 upwardly relative to the die member 30, or by moving the die member 30 downwardly relatively to the pattern portion 10.

As shown in the drawings, the transfer passages 20 and finger passages 22 are helical, i.e., are disposed at a slight angle relative to the axis 14 of the cylindrical bore 12. The transfer passages 20 are mirror images of each other, and only one will be described. Each transfer passage 20 includes an open entry end 34 and a closed remote end 36. The transfer passage 20 is defined by opposed side walls 38 and 40, by an end wall 42 at the remote end 36, and by a radially outer wall 44. The side wall 38 is inclined upwardly and inwardly, the side wall 40 is inclined upwardly and outwardly, and the outer wall 44 is inclined upwardly and inwardly.

The transfer passage 20 includes a first undercut portion, region or area 46 (see FIG. 3) which is located to the right of a line 48 (shown in FIG. 3) and which prevents separation, in the direction along the axis 14 of the cylindrical bore 12, of a one-piece member forming the transfer passage 20. The transfer passage 20 also includes a first portion 50 which is located to the left of the line 48 and which permits die member separation in the direction along the axis 14 of the cylindrical bore 12.

In order to overcome the problem presented by the first undercut portion 46, the main portion 32 of the die member 30 includes (see FIG. 2) a projection 52 forming a first part 54 of the first portion 50 of the transfer passage 20, i.e., the part to the left of a line 56 (shown in FIG. 2), and the die member 30 also comprises a core 58 carried by the main portion 32 and movable relative to the main portion 32 along a line 60 (see FIG. 2) in a plane substantially perpendicular to the axis 14 of the cylindrical bore 12. The core 58 is movable between an extended position (see the lower core 58 in FIG. 2) in which the core 58 forms a second part 62 of the first portion 50 (the part to the right of the line 56 in FIG. 2), the first undercut portion 46, and the finger passage 22, and a retracted position (see the upper core 58 in FIG. 2) in which the core 58 is withdrawn from the first undercut portion 46 and from the finger passage 22 and affords separation of the core 58 through the second part 62 of the first portion 50 of the transfer passage 22 and in common with separation of the projection 52 from the first portion 50 of the transfer passage 20 in the direction along the axis 14 of the cylindrical bore 12. In other words, the core 58 affords removal of the die member from the pattern portion 10 in the direction along the axis 14 of the cylindrical bore 12 when the core 58 is in its retracted position.

As shown in FIG. 2, the transfer passage 20 also includes a second portion 64 which is located to the right of a line 66 and which permits movable core separation along the line 60, and a second undercut portion 68 which is located to the left of the line 66 and which prevents one-piece core separation along the line 60. The projection 52 forms the second undercut portion 68 and a first part 70 of the second portion 64 of the transfer passage 20, i.e., the part located to the left of the line 56. When in its extended position, the 58 core forms a second part 74 of the second portion 64, i.e., the part located to the right of the line 56. When located in its retracted position, the core 58 is partially withdrawn from the second portion 64.

Any suitable arrangement known in the die casting art can be employed for causing movement of the core 58 relative to the main portion 32 of the die member 30 along the line 60 and at a time after casting of the pattern portion 10 and before separation of the pattern portion 10 and the die member 30.

Various features of the invention are set forth in the following claims.

I claim:

1. A die member for forming a foam pattern for casting a cylinder block in a lost foam casting process, the pattern having a cylindrical bore with an axis, and a helical transfer passage including a first portion permitting die member separation in a direction along the axis of the cylindrical bore, and an undercut portion preventing one-piece die member separation in the direction along the axis of the cylindrical bore, said die member comprising a main portion forming at least a portion of the cylindrical bore and including a projection forming a first part of the first portion of the transfer passage, and a core carried by said main portion and movable relative to said main portion along a line in a plane substantially perpendicular to the axis of the cylindrical bore, said core being movable between an extended position in which said core forms a second part of the first portion of the transfer passage and the undercut portion of the transfer passage, and a retracted position in which said core affords removal of said die member from the pattern in the direction along the axis of the cylindrical bore.

2. A die member as set forth in claim 1 wherein the pattern also has a helical finger passage adjacent the transfer passage, wherein said core forms the finger passage when said core is in said extended position, and wherein said core is completely withdrawn from the finger passage when said core is in said retracted position.

3. A die member as set forth in claim 2 wherein one of the transfer passage and the finger passage includes a second undercut portion preventing one-piece core separation along said line, and wherein said main portion includes a projection forming the second undercut portion.

4. A die member as set forth in claim 1 wherein the transfer passage includes a second undercut portion preventing one-piece core separation along said line, and wherein said projection forms the second undercut portion.

5. A die member for forming a foam pattern for casting a cylinder block in a lost foam casting process, the pattern having a cylindrical bore with an axis, a helical transfer passage, and a helical finger passage adjacent the transfer passage, said die member comprising a main portion forming at least a portion of the cylinder bore, and a core carried by said main portion and movable relative thereto, said core being movable between an extended position in which said core forms at least a portion of each of said transfer passage and said finger passage, and a retracted position in which said core affords removal of said die member from the pattern in the direction along the axis of the cylindrical bore.

6. A die member as set forth in claim 5 wherein one of the transfer passage and the finger passage includes first and second portions, wherein said main portion includes a projection forming the second portion and a first part of the first portion, wherein said core forms a second part of the first portion and the other of the transfer passage and the finger passage when said core is in said extended position, and wherein said core is at least partially withdrawn from the second part and from the other of the transfer passage and the finger passage when said core is in said retracted position.

7. A die member as set forth in claim 6 wherein the first portion permits movable core separation along a line in a plane substantially perpendicular to the axis of the cylindrical bore, wherein the second portion is undercut and prevents one-piece core separation along said line, and wherein said core is movable relative to said main portion along said line.

8. A die member as set forth in claim 7 wherein the transfer passage includes the first and second portions.

9. A die member for forming a foam pattern for casting a cylinder block in a lost foam casting process, the pattern having a cylindrical bore with an axis, a helical transfer passage including a first portion permitting die member separation in the direction along the axis of the cylindrical bore, a first undercut portion preventing one-pie die member separation in the direction along the axis of the cylindrical bore, a second portion permitting movable core separation along a line in a plane substantially perpendicular to the axis of the cylindrical bore, and a second undercut portion preventing one-piece core separation along said line, and the pattern also having a helical finger passage adjacent the transfer passage, said die member comprising a main portion forming the cylinder bore and including a projection forming the second undercut portion of the transfer passage, a first part of the second portion of the transfer passage, and a first part of the first portion of the transfer passage, and a core carried by said main portion and movable relative to said main portion along said line, said core being movable between an extended position in which said core forms a second part of the first portion, a second part of the second portion, the first undercut portion, and the finger passage, and a retracted position in which said core is withdrawn from the first undercut portion, is partially withdrawn from the second portion and is withdrawn from the finger passage and affords removal of said die member from the pattern in the direction along the axis of the cylindrical bore.

* * * * *